US010151190B2

(12) United States Patent
Cherry

(10) Patent No.: US 10,151,190 B2
(45) Date of Patent: Dec. 11, 2018

(54) ASSESSMENT AND PRODUCTION OF MINERALS BY DIRECTED HORIZONTAL DRILLING

(71) Applicant: Richard Muriel Cherry, Norman, OK (US)

(72) Inventor: Richard Muriel Cherry, Norman, OK (US)

(73) Assignee: Richard Muriel Cherry, Norman, OK (US)

( * ) Notice: Subject to any disclaimer, the term of this patent is extended or adjusted under 35 U.S.C. 154(b) by 0 days.

(21) Appl. No.: 15/485,053

(22) Filed: Apr. 11, 2017

(65) Prior Publication Data

US 2017/0241266 A1 Aug. 24, 2017

Related U.S. Application Data

(63) Continuation-in-part of application No. 14/849,797, filed on Sep. 10, 2015, now abandoned.

(51) Int. Cl.
*E21B 43/29* (2006.01)
*E21B 43/30* (2006.01)
(Continued)

(52) U.S. Cl.
CPC ..... *E21B 43/29* (2013.01); *E21B 33/13* (2013.01); *E21B 43/30* (2013.01); *E21B 43/305* (2013.01);
(Continued)

(58) Field of Classification Search
CPC ..... E21B 43/29; E21B 43/283; E21B 43/285; E21B 43/00; E21B 43/14; E21B 43/28;
(Continued)

(56) References Cited

U.S. PATENT DOCUMENTS 4,221,433 A * 9/1980 Jacoby ..... E21B 43/17 166/271
4,676,313 A * 6/1987 Rinaldi ..... E21B 43/12 166/250.15

(Continued)

*Primary Examiner* — John J Kreck
*Assistant Examiner* — Michael A Goodwin
(74) *Attorney, Agent, or Firm* — Crowe & Dunlevy, P.C.

(57) ABSTRACT

Systems and methods for extracting minerals from an underground mineralization zone located below the surface at an oil and gas drilling site. The system includes a vertical drilling means for drilling a vertical bore extending from the surface at the oil and gas drilling site into the mineralization zone, a second horizontal drilling means for drilling at least one horizontal production bore into the mineralization zone. The first horizontal drilling means and the second horizontal drilling means are configured to return material from the mineralization zone to the surface where the mineral content of the material is analyzed and a separator separates minerals, waste and drilling mud from the material. The method includes steps of drilling a horizontal assessment bore, analyzing assessment material for a desired mineral, drilling a horizontal production bore, producing production material containing the desired mineral, and separating the desired material from waste and drilling mud.

11 Claims, 2 Drawing Sheets

(51) Int. Cl.

| | |
|---|---|
| ***E21B 43/34*** | (2006.01) |
| ***E21B 33/13*** | (2006.01) |
| ***E21B 49/02*** | (2006.01) |
| ***E21C 41/16*** | (2006.01) |
| *E21B 21/06* | (2006.01) |

(52) U.S. Cl.
CPC ..... *E21B 43/34* (2013.01); *E21B 49/02* (2013.01); *E21C 41/16* (2013.01); *E21B 21/06* (2013.01)

(58) Field of Classification Search
CPC ..... E21B 43/30; E21B 43/281; E21B 21/06; E21B 49/005; E21B 7/28; E21B 10/26
See application file for complete search history.

(56) References Cited

U.S. PATENT DOCUMENTS 7,204,323 B2 4/2007 Kingsley
2003/0024700 A1 2/2003 Cavender
2004/0108110 A1 6/2004 Zupanick
2012/0027516 A1* 2/2012 Day ..... C01D 7/00 405/55
2013/0146285 A1* 6/2013 Chhina ..... E21B 43/00 166/268
2014/0020954 A1* 1/2014 Pelletier ..... G01J 3/2823 175/50
2015/0204179 A1* 7/2015 Affholter ..... E21B 43/24 166/245
2015/0356403 A1* 12/2015 Storm, Jr. ..... G06N 3/08 706/12
2016/0003023 A1* 1/2016 O'Rear ..... E21B 43/00 166/250.01
2016/0032718 A1* 2/2016 Jones ..... E21B 49/005 73/152.28
2017/0043965 A1* 2/2017 Blaine ..... E21B 49/005

* cited by examiner

ASSESSMENT AND PRODUCTION OF MINERALS BY DIRECTED HORIZONTAL DRILLING

RELATED APPLICATIONS

This application claims priority from, and is a continuation-in-part of U.S. patent application Ser. No. 14/849,797 entitled "Directed Drilling for the Recovery of Hard Rock Minerals," filed Sep. 10, 2015, the disclosure of which is hereby incorporated by reference.

FIELD OF THE INVENTION

The present invention relates generally to the field of mineral extraction from underground mineral deposits, and more particularly, but not by way of limitation, to a system and method for assessing and producing minerals through directed horizontal drilling.

BACKGROUND OF THE INVENTION

Mining for hard rock minerals from underground mining deposits has typically been an expensive and laborious process. Past mining methods often required the drilling of hundreds of large sampling wells to assess the size and economic value of an underground mineral deposit. Once a desired mineral deposit was located, traditional mining methods consisted of excavating a large shaft, decline or adit into the mineral deposit to allow access into the underground mineral deposit by personnel and equipment. This type of excavation frequently required large equipment, explosives and additional methods and materials to secure and support the excavation to prevent collapse. Also, these traditional methods of mining are required for the displacement of large quantities of waste materials and water, often requiring leaching agents to extract the minerals, which can result in environmental destruction.

There have been hundreds of thousands of oil and gas wells drilled in the United States and even more in other countries. These wells are sometimes drilled to depths of over fifteen thousand feet and are often drilled through regions of rock which could contain minerals that could not be recovered through the traditional rock-mining methods due to the location and depth of the deposits. Nevertheless, these mineral deposits are typically ignored by oil and gas operators, and the hard-rock minerals are passed by and not recovered from the fluids produced from such wells.

Accordingly, there is a need for cost-effective ways to utilize existing or future oil and gas wells to assess and produce hard-rock minerals located beneath the surface that overcomes these other deficiencies in the prior art. It is to these and other objects that the present invention is directed.

SUMMARY OF THE INVENTION

In an embodiment, the present invention includes a system for extracting minerals from an underground mineralization zone located below the surface at an oil and gas drilling site. The system includes a vertical drilling means for drilling a vertical bore at the oil and gas drilling site, where the vertical bore extends from the surface to the mineralization zone. The system further includes a first horizontal drilling means for drilling at least one horizontal assessment bore into the mineralization zone and a second horizontal drilling means for drilling at least one horizontal production bore into the mineralization zone. The system obtains material from the mineralization zone to the surface through either or both of the horizontal assessment bore of the horizontal production bore. After material is returned to the surface, an analysis means analyzes the mineral content of the material and a separator located at the surface separates minerals, waste and drilling mud from the material. The system may also include a sensor located within the horizontal assessment bore to analyze mineral content in the mineralization zone. The system may also include a mixing means to create a mixture of the waste material created by the separator and a cement material. The cement mixture may be reinserted into the at least one horizontal production bore to provide structural strength and close of the horizontal production bore after the desired minerals are extracted.

In yet another aspect, the present invention includes a method for extracting minerals from an underground mineralization zone located below a surface at an oil and gas drilling site. The method includes the steps of drilling at least one horizontal assessment bore in the mineralization zone, analyzing assessment material from at least one of the horizontal assessment bores to determine if a desired mineral is present in the assessment material, drilling at least one horizontal production bore through the location of the at least one horizontal assessment bore where minerals are present, and producing production material containing the desired mineral, waste and drilling materials from the at least one horizontal assessment bore to the surface. After the production material is produced to the surface, the method continues with the step of separating the desired mineral from the waste and drilling materials. The method may also continue with the step of analyzing the production material at the surface to ensure desired mineral is continuously present, and if no desired material is present in the analysis, stopping further production from the horizontal production bore. The method then may include the steps of mixing the waste with a cement material to create a cement mixture, and returning the cement mixture into the at least one horizontal assessment bores to close off the at least one horizontal assessment bore when there is no desired mineral present.

DETAILED DESCRIPTION OF THE PREFERRED EMBODIMENTS

Figure 1:
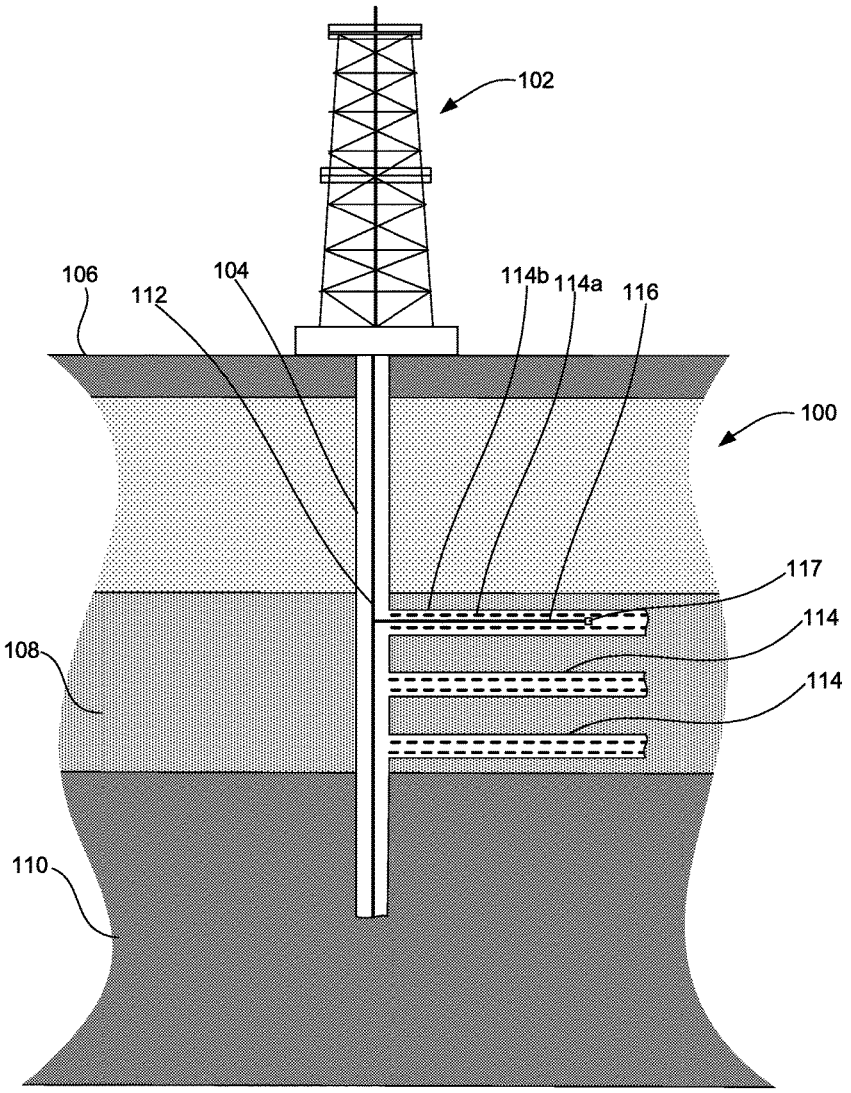
FIG. 1 is a cross-sectional view of the mineral extraction system at an oil and gas installation.

FIG. 1 shows a cross-sectional view of the mineral extraction system 100 installed at an oil and gas well site 102. The mineral extraction system 100 utilizes a vertical bore 104 drilled at the oil and gas well site 102. The vertical bore 104 is drilled utilizing known drilling methods. The vertical bore 104 extends from the surface 106 downward and passes through a mineralized zone 108 and into the oil and gas production zone 110. After the vertical bore 104 is drilled, a production string 112 is placed in the vertical bore to allow for the placement of downhole production equipment. Additionally, drilling mud and downhole materials are circulated through the vertical bore 104 and through the production string 112 to the surface 106.

In a preferred embodiment, one or more horizontal bores 114 are directed horizontally out into the mineralized zone 108. Since the oil or gas well 102 may be the only contact with the possible mineralized zone 108 for many square miles below the surface 106, the one or more horizontal bores 114 could extend for miles horizontally from the oil and gas well site 102 The horizontal bores 114 may extend in multiple radial directions and in multiple horizontal depths to locate the bounds of the mineralized zone 108. The horizontal bores 114 can be created through the use of directed horizontal oil and gas drilling technology. It will be understood that the horizontal bores 114 can also be of various sizes in diameter. In a preferred embodiment, the horizontal bores 114 are first drilled with a small diameter for sampling the minerals in the mineralized zone 108. These small diameter horizontal bores may be referred to as horizontal assessment bores 114*a*. Later, the horizontal bores 114 may be drilled to a much larger diameter for obtaining large quantities of the minerals discovered. These larger diameter horizontal bores may be referred to as a horizontal production bores 114*b*.

As the horizontal bores 114 are being created, horizontal tubing 116 is run into the one or more horizontal bores 114. The horizontal tubing 116 contains remote sensing equipment 117. The remote sensing equipment 117 may analyze the mineral content at the site of the horizontal bores 114 underground, or may alternatively return samples to the surface 106 where the samples are analyzed to determine if the desired minerals are present and if the economic value of the mineral deposit is sufficient. The remote sensing equipment 117 used may vary based on the minerals that are expected to be found in the mineralization zone 108. It will be understood that common hard rock minerals being located in the mineralization zone may include precious metals, gold, silver, platinum, rare earths and uranium. These minerals may be economically recovered at relatively low concentrations. Additionally, other minerals containing high concentrations of lesser valuable metals may be economical if the concentration is high enough and refining or processing facilities are near.

If the sampled material shows a positive economic result, then production boring equipment (not depicted) can be installed at the oil and gas well site 102. Production boring equipment is used to drill and enlarge one or more of the horizontal bores 114 along the path indicated by the samples that showed positive economic results. In a preferred embodiment, the horizontal bore 114 is drilled by a drill motor powered by a drilling mud and water. The drilling mud is circulated to the surface returning the drill cuttings which contain the mineral to be recovered. For many applications the drill cuttings will be processed by appropriate equipment on the surface to separate mineral content from drill waste. The drill cuttings are separated at the surface 106 from the drilling mud by various methods depending upon the mineral being recovered. The drilling mud is then returned to the vertical bore 104 and the horizontal bore 114 to assist in additional drilling. The mineral material that has been separated is collected for shipment to a facility that can refine the contained minerals into marketable materials. The waste is collected for redeposit in the horizontal bores 114 or for shipment to a disposal facility. The length of each horizontal bore 114 will depend upon the mineral deposit being drilled. Larger diameter horizontal bores 114 will result in more economical mineral recovery. The production boring equipment should use the largest diameter drilling equipment that is economically available.

When the horizontal bore 114 has been depleted of minerals or if further drilling is not desired, then the production equipment and tubing will be removed from the one or more horizontal bores 114. It can then be used to drill additional horizontal bores 114 from the same vertical access bore offset from any other previous horizontal bores 114 by a distance which will allow for no loss of drilling mud into previous horizontal bores. This distance will be determined by the accuracy of the drilling method and the geology of the mineral deposit. For those mineral deposits that require a large amount of mineral due to the economies for the mineral, each horizontal bore 114 could be filled with a combination of cementing material and waste rock, which would provide structural strength and close off the previous horizontal bore 114 from drilling mud. By using cementing material combined with the waste rock recoveries above 70% could be achieved depending on the accuracy of the horizontal drilling methods.

It will be understood that the method of drilling at least one horizontal bore with production boring equipment may be utilized at any desired location where minerals are known or thought to be present. Although the above system is described at an oil and gas site 102, minerals could be obtained from a mineralization zone located at a traditional mining location where the minerals are already known but previously not obtainable due to the size of the mineral deposits of the depth or structural instability.

Figure 2:
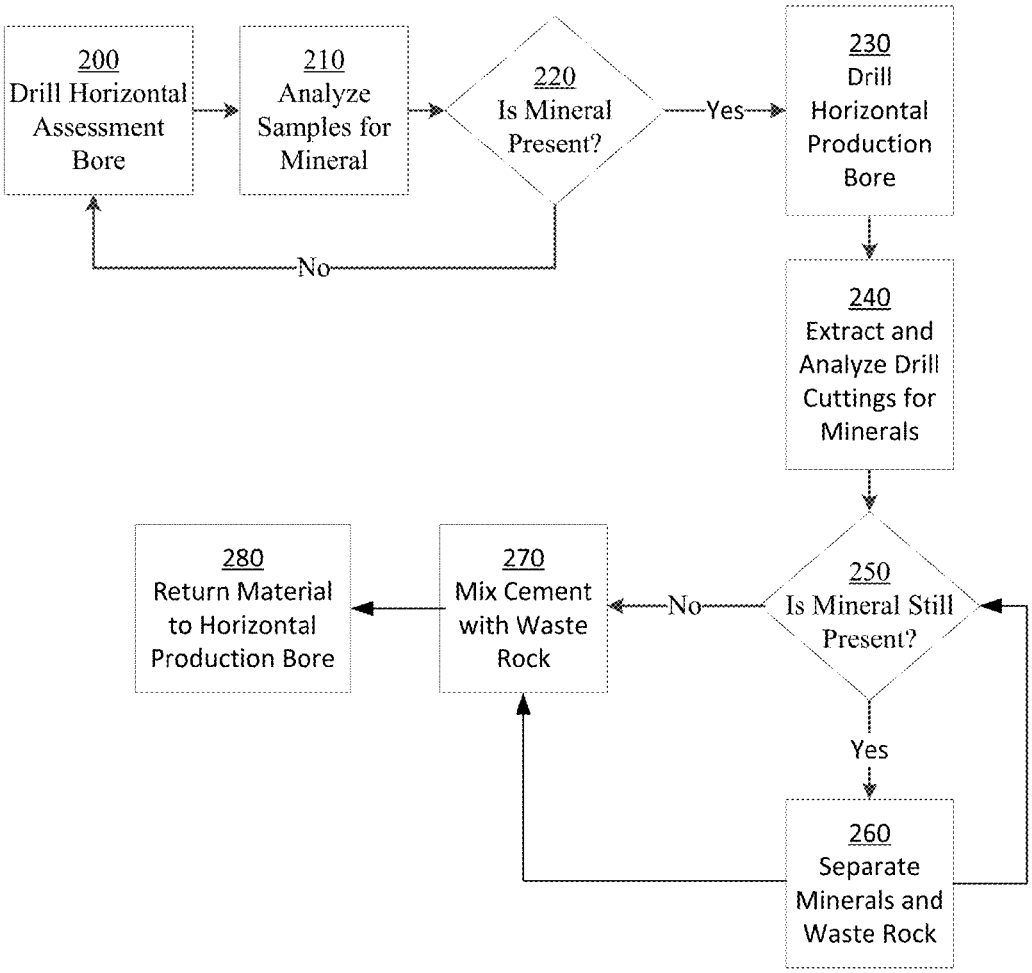
FIG. 2 is a flowchart depicting a mineral extraction method.

Turning now to FIG. 2, depicted therein is a flow chart showing the process of assessing and producing minerals utilizing horizontal drilling methods. In step 200 the process begins by drilling a horizontal assessment bore into the mineralized zone. Then, in step 210, the process analyzes samples obtained in the horizontal assessment bore. In step 220, the process determines if the desired mineral content exists in the obtained samples. If there is no desired mineral present in the sample, or if there is insufficient mineral concentration within the sample, then the process returns to step 200 and another horizontal assessment bore is drilled. It will be understood that multiple horizontal assessment bores can be drilled at the same time and that samples from the multiple assessment bores may be analyzed simultaneously.

If, in step 220, the process determines that there is sufficient desired mineral concentration present in the obtained sample, then in step 230, a horizontal production bore is drilled in the location where the sample was obtained. After the horizontal production bore is drilled, then in step 240, the drill cuttings are extracted to the surface along using known methods and analyzed to determine mineral content. In step 250, the process determines whether sufficient mineral concentration is still present in the drill cuttings. If there is sufficient mineral concentration, then in step 260, the minerals are separated from the waste rock and the drilling mud. It will be understood that the production process is constantly returning samples through the drill cuttings to the surface for analysis, and the process runs until either no minerals are located in the drill cuttings or if the desired length of the horizontal production bore has been reached. Next, in step 270, the waste rock is mixed with cement. After mixing, then in step 280, the cement is returned to the horizontal production bore to allow an additional horizontal production bores to be drilled.

The system and method creates a process to assess and recover minerals at depths and in environments that may not have been accessible before by using horizontal and directional drilling techniques and equipment instead of past non-economical mining methods.

It is to be understood that even though numerous characteristics and advantages of various embodiments of the present invention have been set forth in the foregoing description, together with details of the structure and functions of various embodiments of the invention, this disclosure is illustrative only, and changes may be made in detail, especially in matters of structure and arrangement of parts within the principles of the present invention to the full extent indicated by the broad general meaning of the terms in which the appended claims are expressed. It will be appreciated by those skilled in the art that the teachings of the present invention can be applied to other systems without departing from the scope and spirit of the present invention.

It is claimed:

1. A method for extracting minerals from an underground mineralization zone, the method comprising:

drilling a horizontal assessment bore in the mineralization zone, said horizontal assessment bore having a location;

analyzing assessment material produced from the horizontal assessment bore to determine if a desired mineral is present in the assessment material;

drilling a horizontal production bore at the location of the horizontal assessment bore where the desired mineral is present;

producing production material from the horizontal production bore, wherein the production material comprises:

waste material; and the desired mineral; and separating the desired mineral from the waste material.

2. The method of claim 1 further comprising:

analyzing the production material determine whether the desired mineral is present; and stopping the production of the production material when no desired mineral is present.

3. The method of claim 2 further comprising:

mixing the waste material with a cement material to create a cement mixture; and inserting the cement mixture into the horizontal production bore to close off the horizontal production bore when there is no desired mineral present.

4. The method of claim 3, wherein the cement mixture provides structural strength to the mineralization zone to allow for a second horizontal production bore to be drilled and prevent loss of drilling mud into the horizontal production bore.

5. The method of claim 1, wherein the horizontal assessment bore has a smaller diameter than the horizontal production bore.

6. A method for extracting minerals from an underground mineralization zone located at an oil and gas well site, the method comprising:

drilling a vertical bore through the mineralization zone;

drilling a plurality of horizontal assessment bores in the mineralization zone, wherein each of the horizontal assessment bores has a location;

analyzing assessment material produced from the plurality of horizontal assessment bores to determine if a desired mineral is present in the assessment material;

drilling a horizontal production bore at the location of each horizontal assessment bore where the desired mineral is present;

producing production material from the horizontal production bore, wherein the production material comprises:

waste material; and the desired mineral; and separating the desired mineral from the waste material.

7. The method of claim 6, wherein each of the plurality of horizontal assessment bores extend horizontally out from the vertical bore in a different direction.

8. The method of claim 6, wherein the location of each of the plurality of horizontal assessment bores is at a different depth.

9. The method of claim 6, wherein each of the plurality of horizontal assessment bores has a smaller diameter than the horizontal production bore.

10. A method for extracting minerals from an underground mineralization zone, the method comprising:

drilling a vertical bore through the mineralization zone;

drilling a horizontal assessment bore in the mineralization zone, said horizontal assessment bore having a location;

inserting production tubing into the horizontal assessment bore, wherein the production tubing comprises a remote sensing equipment;

analyzing assessment material in the horizontal assessment bore with the remote sensing equipment to determine if a desired mineral is present in the assessment material;

drilling a horizontal production bore at the location of the horizontal assessment bore where the desired mineral is present;

producing production material from the horizontal production bore, wherein the production material comprises:

waste material; and the desired mineral; and separating the desired mineral from the waste material.

11. The method of claim 10, wherein the horizontal assessment bore has a smaller diameter than the horizontal production bore.

* * * * *